United States Patent [19]

Goto et al.

[11] 3,971,539

[45] July 27, 1976

[54] METHOD FOR PREVENTING THE ADHESIVE DEPOSITION OF SLUDGE ON THE SURFACE OF PARTS OF A PLANT FOR TREATING METAL SURFACES

[75] Inventors: Issei Goto, Funabashi; Suzo Hara, Sakura, both of Japan

[73] Assignee: Parker Sangyo Co., Ltd., Tokyo, Japan

[22] Filed: Sept. 27, 1973

[21] Appl. No.: 401,146

[30] Foreign Application Priority Data

Nov. 29, 1972 Japan ..... 47-118870

[52] U.S. Cl. ..... 250/529; 148/6.15 R; 204/147; 118/639; 118/70

[51] Int. Cl.[2] ..... B01K 1/00; B05B 5/02

[58] Field of Search ..... 118/639, 640, 70; 250/529; 204/147; 302/14, 64; 148/6.15; 427/47

[56] References Cited

UNITED STATES PATENTS

| | | | |
|---|---|---|---|
| 430,461 | 6/1890 | Bull | 250/529 |
| 2,652,925 | 9/1953 | Vermeiren | 250/529 |

OTHER PUBLICATIONS

Welder et al., "Practical Performance . . . Gadgets," I & EC, vol. 46, No. 5, pp. 954–960.

*Primary Examiner*—John D. Welsh
*Attorney, Agent, or Firm*—Oblon, Fisher, Spivak, McClelland & Maier

[57] ABSTRACT

A method and apparatus for preventing the deposition of a sludge onto the surface of parts exposed to a metal treating solution which contains a sludge such as a phosphate or chromate solution, which comprises passing the solution for treating the metal surfaces through a magnetic field generated by magnets attached on the surfaces of non-magnetic conduits through which a portion of the solution is passed.

5 Claims, 3 Drawing Figures

METHOD FOR PREVENTING THE ADHESIVE DEPOSITION OF SLUDGE ON THE SURFACE OF PARTS OF A PLANT FOR TREATING METAL SURFACES

BACKGROUND OF THE INVENTION

1. Field of the Invention

This invention relates generally to a method and apparatus for preventing the deposition of sludge on the surface of parts of a metal treating apparatus, and more particularly, to a method and apparatus utilizing a magnetic field to prevent the deposition of a sludge, such as phosphate, on the inner surface of piping and nozzles through which hot sludge containing solutions are conducted and sprayed.

2. Description of the Prior Art

The metal surfaces of such metallic materials as iron, steel, aluminum, stainless steel and the like are treated with treating solutions for chemical conversion coating, degreasing and pickling during the processing of the metallic materials for numerous industrial purposes. One method of treating these metal surfaces with, for example, a phosphate conversion coating solution, is by dipping the metal into a phosphate coating solution heated at a temperature ranging from about 50 to 98°C in a recirculating tank or by spraying the phosphate coating solution heated to a temperature within this range onto the metal surface. The phosphate coating solution is recirculated and replaced constantly with fresh solution in quantities sufficient to maintain a substantially contant concentration while the temperature of the solution is also maintained at a substantially constant temperature. When the solution is used repeatedly over a long period of time, a sludge, for example an insoluble phosphate sludge, is formed by the reaction of the phosphate coating solution with the metal to be treated. This sludge is deposited on the inner surfaces of the spraying conduits and the openings of the nozzles whereby the nozzles become clogged. Also, the sludge is firmly deposited on the surface of the heating coils in the recirculating tank and can be removed only with great difficulty.

Conventionally, this sludge is removed by discontinuing the treating operation and removing the spray conduits, spraying nozzles, heating coil, and the like which are hammered or brushed manually. Alternatively, the sludge has been removed chemically be immersing these parts into a solution of caustic soda, or the like and soaked for a long time. These removal processes require the stopping of the treating operation and the disassembling of the conduits and nozzles, resulting in an expensive loss in time and labor. In addition, the chemical processes for removing the sludge result in environmental pollution problems and has the dissadvantages incidentally associated therewith, such as waste liquid treatment and the like. A need exists, therefore, to provide a method which is both economical and environmentally safe for preventing the build up of sludge.

SUMMARY OF THE INVENTION

Accordingly, one object of this invention is to provide a simple and inexpensive method for preventing the deposition of sludge on the surfaces of parts of an apparatus for treating metal surfaces.

Another object of this invention is to provide a method which prevents the deposition of sludge on the inner surfaces of conduits and does not clog the spraying nozzles of an apparatus for spraying a treating solution, such as a phosphate treating solution, at a low pressure ranging from about 0.5 to 2.0 kg/cm$^2$.

Yet another object of this invention is to prevent the deposition of hard scale on the outer surfaces of the heating coils used for heating the treating solution in the apparatus.

Still another object of this invention, is to improve the apparatus and heat efficiencies of a metal treating apparatus and save the time and labor required for disassembling, cleaning, assembling and the like of nozzles, coils and pipes presently required in the cleaning of the apparatus.

Briefly, these and other objects of the invention are achieved by passing the hot sludge-containing solution through a magnetic field generated by means of magnets attached to the outer non-magnetic surface of pipes which conduct the hot sludge containing solution from heating tank to the spraying nozzles.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings wherein.

DETAILED DESCRIPTION OF THE PREFERRED EMBODIMENTS

Figure 1:
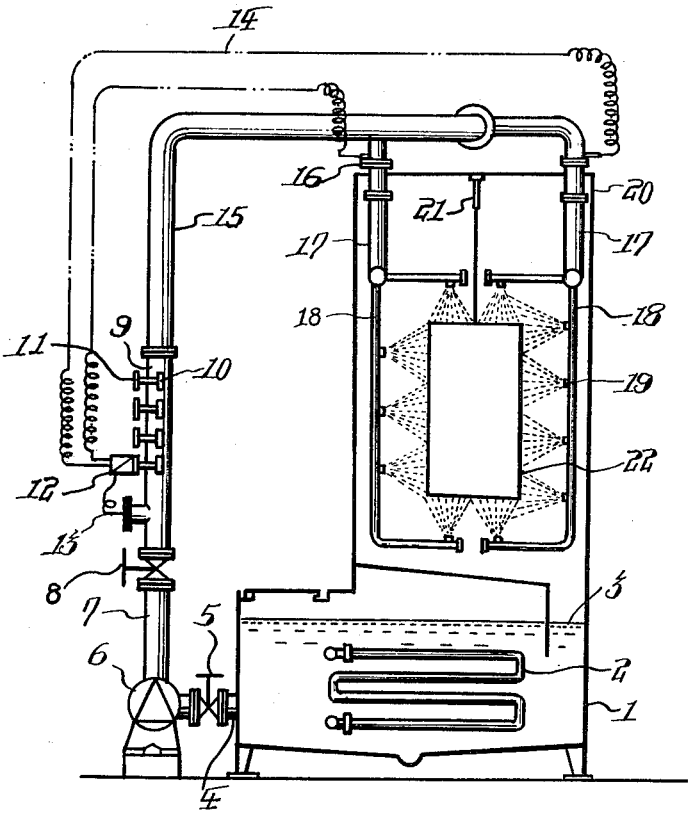
FIG. 1 is a side view of a preferred embodiment of the instant invention.
Figure 2:
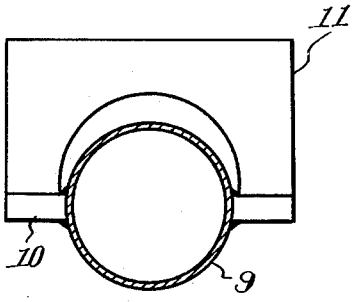
FIG. 2 is a sectional view of a magnet attached onto a pipe of the treating apparatus.
Figure 3:
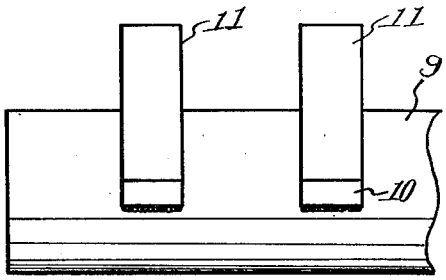
FIG. 3 is a side view of a pipe having magnets attached thereon.

In accordance with the present invention, the deposition of sludge on the surfaces of a metal treating apparatus has been prevented by passing the hot sludge containing solution through a magnetic field generated by means of material, force magnets attached to the conduits of the treatment apparatus. Although the exact manner in which the lines of magnetic force act on the hot sludge containing solution has not been determined at present, it appears, however, that when the sludge-containing solution is passed through a magnetic field formed by a ferromagnetic maerial, particles of the sludge begin to have a magnetic moment and the magnetized condition is maintained for a considerable length of time. Also, the ions contained in the treatment solution passing through the lines of magnetic forcee are effected magnetically by the action of magnetic field so that any aggregate of the various sludge crystals, such as phosphate crystals, making up the sludge would be reduced in size and converted to microcrystals of unstable phosphate which does not deposit as sludge on the surface of parts of the treating apparatus.

The method of the present invention is not restricted to any particular metal surface treating apparatus or metal treating solution, but is applicable to various apparatus and treating solutions including those for phosphate conversion coating or chromate conversion coating by dipping into or by spraying at a low pressure with a solution for treating the metal surfaces, degreasing apparatus, pickling apparatus, and the like. The parts of the apparatus generally comprise a tank, coil heater, nozzles, conduits, pumps, and the like although other parts may be included depending upon the type of treating operation without deviating from the scope of the present invention. Suitable materials from which these parts may be made include stainless steel, lead, steel, resins, rubber and the like. The metal surface treating solutions include those for chemical conversion coating such as solutions containing zinc phosphate, chromate or the like, degreasing solutions such as those containing caustic soda, sodium phosphate, sodium alkylbenzene sulfonate and pickling solutions such as sulfuric acid, hydrochloric acid, or the like.

The solution for treating metal surfaces is fed into a recirculating tank in which it is heated by introducing steam or hot water into a heating means such as a heating coil, and the like, or by means of a burner or heater. The heating temperature depends on the purpose for the treatment but is generally within the range from about 50° to 98°C.

The solution for treating metal surfaces may have any conventional composition and concentration. For example, a zinc phosphate coating solution containing zinc in the range from about 1 to 8 grams/liter, phosphate in the range from about 5 to 20 grams/liter and nitrate in the range from about 1 to 10 grams/liter may be used. At the beginning of treating operation the solution contains no sludge but since the solution is recirculated, the amount of sludge increases progressively as the treating operation proceeds and is generally contained in an amount varying from about 1 to 10 grams/liter.

The composition of the sludge depends on the type of treating solution and metal to be treated. In a phosphate conversion coating method, for example, the treating solution contains iron phosphate, zinc phosphate, chromium phosphate, aluminum phosphate and the like. The solution heated in the recirculating tank is recirculated through the conduits by means of a pump. The amount of solution to be fed to the spray nozzle depends on the surface area per unit time to be treated and in general, the conduits of the treating apparatus have a diameter ranging from 2 to 12 inches.

The magnet to be installed on the outer surface of the conduit for delivering the solution to the means for treating the metal surfaces includes permanent magnets, electromagnets, or the like, having a bar shape, retangular hexahedron, or horse shoe shape or the like. When the magnets are to be installed on the conduit, a non-magnetic stainless steel conduit, e.g., pipe, having a length corresponding to that of the magnets is inserted between the solution flowing conduit by means of a flange joint or by welding.

Supporting plates are installed on the non-magnetic conduit by welding or the like for placing the magnets, and on which magnets are secured by means of bolts. When the non-magnetic conduit is located horizontally, the magnets may be placed thereon without the need of securing them to the conduit. Permanent magnets or electromagnets may be secured to the nonmagnetic conduit so that the lines of magnetic force intersect, the solution passing through the conduit, preferably perpendicularly.

When permanent magnets are employed they may be secured in the following manner: A pair of bar type permanent magnets, rectangular hexahedron magnets or the like are symmetrically attached on both sides of the non-magnetic stainless steel conduit. A magnetizable plate of pure iron or steel is connected with each pair of magnets so as to form a bridge therebetween. Alternatively, each magnet of semi-circular, horse shoe or U-shape is installed symmetrically on a supporting plate so as to bridge the non-magnetic stainless steel conduit and if necessary, secured by means of supporting members.

The installed magnet has, in general, a magnetic flux ranging from 3000 to 5000 gauss. The location of the installed magnet and magnetic length can be optionally selected depending on the size and shape of the recirculating tank and the conduits for supplying the solution to the surface treating means, i.e., nozzles. The only requirement is to form a magnetic field in the conduit by passing the lines of magnetic force therethrough. Accordingly, a permanent magnet may be placed in a non-magnetic metal case, which may be supported and arranged by fixing it on the outer surface of the conduit.

In order to prevent any corrosion in the apparatus, a weak direct current may be applied between a cathode connected to the conduits of the apparatus and an anode immersed directly in the solution for treating the metal surface in the tank or in the conduits. Such an electric current does not cause the removal of sludge as does the action of the magnet, but the current can inhibit the corrosion of the apparatus for a long period of time.

Referring now to the drawings, wherein like reference numerals designate identical or corresponding parts through the several views, and more particularly FIG. 1 which is a side view of a conversion coating apparatus, such as for phosphate, for spraying a coating solution, such as phosphate, which is conveyed through the conduits upon which magnets are mounted.

Recirculating tank 1, contains a coating solution 3, such as phosphate, which is heated by steam coil 2 and passes through pipe 4, valve 5, spraying pump 6, pipe 7, valve 8, and non-magnetic pipe 9 which has mounted thereon magnets 11, each on a supporting plate 10. Pipe 15 and pipes 17 which are divided from pipe 15 have a number of spraying pipes 18 respectively connected thereto. The solution is sprayed through each nozzle 19 attached to the spraying pipes 18 onto a metallic article 22 which is transported by means of a conveyer 21. A booth 20 is installed around the spraying pipe 18. After spraying the metallic article, the remainder of the solution is returned to the recirculating tank 3.

In order to prevent any corrosion of the members, an electrode is secured to each pipe 17, the terminal 16 of which is connected to an electric battery 12 by means of lead wire 14. Thus a current ranging from about 1 to 1.5 amps at a D.C. voltage of from about 6 to 10 volts passes between the pipes 17 connected to the terminal 16, which serves as cathodes and an anode 13 inserted into the pipe 9 by connecting the electrodes with the battery 12.

Since the state of the sludge is changed from the firmly adhered and difficult to remove scale type to a removable soft sludge according to this invention, neither clogging of the nozzles nor deposition of sludge on the pipings occurs in a coating apparatus for spraying the solution, such as phosphate, at low pressures. A very soft sludge adheres on the heating coil in a minor amount which can readily be removed without any difficulty by washing with water once every four weeks.

Having generally described the invention, a more complete understanding can be obtained by reference to certain specific examples, which are included for purposes of illustration only and are not intended to be limiting unless otherwise specified.

EXAMPLE 1

A stainless steel recirculating tank having a capacity of 4500 liters was charged with a zinc phosphate coating solution containing zinc in the range of from 2 to 4 grams, phosphate in the range of from 10 to 20 grams and nitrate in the range from 5 to 15 grams per liter of solution. The solution was maintained at a temperature ranging from 50° to 60°C by means of steam supplied to a stainless steel heating coil having a diameter of 50 mm and a length of 40 meters and immersed in the solution in the tank. The solution was passed through a non-magnetic stainless steel pipe which had a diameter of 125 mm and a length of about 1 meter and which was inserted at the delivery side of the pump, at a flow rate of 1650 liters/min. and at a pressure of 1.0 kg/cm$^2$ by means of said pump of 7.5 KW for recirculating the solution to the spraying nozzles.

Four non-magnetic metal cases each on a supporting plate were secured symmetrically on the side of the inserted pipe each at an interval of 160 mm, each non-magnetic metal case containing two magnets comprising a permanent magnet of the bar type having a diameter of 60 mm and a length of 80 mm and having a density of magnetic flux ranging from 3000 to 5000 gauss and a steel strip 300 × 60 × 25 mm was also mounted on the magnets so as to form a bridge over the pipe. The solution was then divided into two streams each in a stainless steel pipe having a diameter of 100 mm.

The solution was then constantly sprayed at a rate of 15 liter/min., vertically and horizontally, over a length of 3500 mm in the spraying zone through 110 spraying nozzles in total, attached on 10 stainless steel pipes having a diameter of 40 mm divided from said two stainless steel pipes of 100 mm each onto metal articles having a surface ranging from at least 50 × 200 mm to at most 1500 × 2000 mm and hanging from a conveyer passing continuously through the spraying zone at a speed of 1.5 meters/min. The excess solution after spraying was returned to the recirculating tank.

In order to prevent corrosion on the surface of the apparatus, a current of 0.5 amps was applied at 8 volts between an anode inserted into the phosphate coating solution at the inlet of the inserted non-magnetic stainless steel pipe and cathodes connected with the spraying pipes at the inlets thereof.

The test was carried out for 542 hours in total over four weeks and the total treated surface area of metal articles was 15016 m$^2$.

TEST RESULTS

After the test had been run for four weeks, the condition of sludge adhered to the apparatus was observed as follows:

The following were observed on the disconnected nozzles, spraying pipes, and the like:

i. Clogging of the nozzles: 76 nozzles out of 110 were not clogged with sludge, 22 nozzles were partially clogged and 12 nozzles were completely clogged.

ii. Deposition in the spraying pipes: Sludge deposited only on the caps attached to portions of the apparatus where the solution stood still. No deposition was observed on the inner surfaces of the pipes.

iii. Deposition on the heating coil: Sludge was deposited in a thickness of from 2 to 3 mm but consisted of fine particles having a size less than 3 mm and could be removed without any difficulty by spraying with a jet stream of water.

Accordingly, it is sufficient to clean the apparatus once every four weeks to insure proper operation.

As a control, the same test was conducted using the same apparatus as disclosed in Example 1, except that magnets were not installed on the outer surface of the non-magnetic pipe and a direct current for preventing the corrosion of apparatus was also ommitted.

The following results were observed on the disconnected nozzles, spraying pipes, and the like:

i. All of the 110 nozzles were clogged with sludge, 40 of which were completely clogged and 70 were partially clogged.

ii. Sludge was deposited on the inner surface of the spraying pipes in a thickness of from 2 to 3 mm. This sludge could not be removed by cleaning with water but required cleaning with 5% hydrochloric acid.

iii. Sludge adhered to the outer surface of the heating coil in a thickness of from 10 to 20 mm as a firm scale which could not be removed without hammering.

In addition, the apparatus had to be cleaned once a week by disconnecting the spraying pipes and nozzles and by immersing them into 5% hydrochloric acid. The scale on the heating coil had to be removed once every week by hammering.

Having now fully described the invention, it will be apparent to one of ordinary skill in the art that many changes and modifications can be made thereto without departing from the spirit or scope of the invention as set forth herein.

What is claimed as new and intended to be covered by Letters Patent is:

1. In a process for depositing a phosphate film onto the surfaces of metallic articles by spraying a phosphate containing coating solution through applicators onto said articles in which the residual phosphate solution resulting from said spraying is gathered in a recirculating tank equipped with heating coils and then returned through a non-magnetic conduit to said applicator means, wherein a means is provided for preventing deposition of an insoluble phosphate sludge in said applicators, on the inner surfaces of said conduit and on the outer surfaces of said heating coils, the improvement which comprises:

preventing deposition of said phosphate sludge by passing said phosphate coating solution containing phosphate sludge in amounts of 1 to 10 grams/liter through said conduit having a diameter of 2 to 12 inches; and simultaneously subjecting said solution to a magnetic field from magnets each possessing a magnetic flux of 3000 to 5000 Gauss.

2. The method of claim 1, wherein said solution is ejected from said conduit through a plurality of nozzles onto a metal intended to be treated, whereby said sludge from said solution is prevented from depositing within said conduit or within said nozzles.

3. The method of claim 1, wherein said solution is continuously recirculated through said conduit and past said magnetic field.

4. The method of claim 1, wherein said magnetic field is generated by permanent magnets which are situated on the periphery of said conduit.

5. The method of claim 1, further comprising the step of attaching said magnet onto the non-magnetic conduit.

* * * * *